US005825378A

United States Patent [19]

Beauchamp

[11] Patent Number: 5,825,378

[45] Date of Patent: Oct. 20, 1998

[54] CALIBRATION OF MEDIA ADVANCEMENT TO AVOID BANDING IN A SWATH PRINTER

[75] Inventor: Robert W. Beauchamp, Carlsbad, Calif.

[73] Assignee: Hewlett-Packard Company, Palo Alto, Calif.

[21] Appl. No.: 719,604

[22] Filed: Sep. 25, 1996

Related U.S. Application Data

[60] Continuation-in-part of Ser. No. 585,051, Jan. 11, 1996, which is a division of Ser. No. 540,908, Oct. 11, 1995, Pat. No. 5,600,350, which is a continuation of Ser. No. 55,624, Apr. 30, 1993, abandoned.

[51] Int. Cl.[6] ..... B41J 29/393

[52] U.S. Cl. ..... 347/19; 347/39; 400/74

[58] Field of Search ..... 400/74, 279; 347/19, 347/5, 37, 39

[56] References Cited

U.S. PATENT DOCUMENTS

| | | | |
|---|---|---|---|
| 5,448,269 | 9/1995 | Beauchamp et al. | 347/19 |
| 5,600,350 | 2/1997 | Cobbs et al. | 347/19 |

*Primary Examiner*—John S. Hilten
*Attorney, Agent, or Firm*—David S. Romney

[57] ABSTRACT

A calibration technique for determining media advance calibration in a swath printer includes drawing a series of lines on media which correspond to an angle of rotation of the platen, and then using an optical sensor to read the actual positions of the lines in order to transmit a correction signal.

6 Claims, 9 Drawing Sheets

CALIBRATION OF MEDIA ADVANCEMENT TO AVOID BANDING IN A SWATH PRINTER

RELATED APPLICATIONS

This application is a continuation-in-part of co-pending Ser. No. 08/585,051 filed on 11 Jan. 1996, which is a divisional of Ser. No. 08/540,908 filed on 11 Oct. 1995 (now U.S. Pat. No. 5,600,350), which is a continuation of Ser. No. 55,264 filed on 30 Apr. 1993 abandoned in the names of Keith E. Cobbs, Robert W. Beauchamp and Paul R. Sorenson.

This application is related to copending application Ser. No. 08/551,022 filed 31 Oct. 1995 in the name of inventors Robert W. Beauchamp, et al., entitled OPTICAL PATH OPTIMIZATION FOR LIGHT TRANSMISSION AND REFLECTION IN A CARRIAGE-MOUNTED INKJET PRINTER SENSOR, which application is assigned to the present assignee and is hereby incorporated by reference.

BACKGROUND OF THE INVENTION

One of the problems in present plotting machines consists in the accumulation of errors in the driving of the paper or printing medium on which the printing is carried out. In this text, the expression "error" has to be considered as the difference between the intended advancement made by the driving motor and the actual advancement made by the paper or printing medium. These errors can be attributed to a multiple causes among which: platen eccentricity, encoder/motor eccentricity, eccentricity of the shaft of the driving mechanisms, especially the worm gear system of the motor, variations of tooth to tooth in the gear driven by the worm, face run out of any gear, etc. . . . .

The mentioned errors are not constant but variable when considering a full turn of the platen. Thus, for instance, the eccentricity has a cyclic effect for each turn of the part taken into consideration and the variations tooth to tooth have a cyclic character at least for a whole turn of the gear. Therefore, the final errors in the advancement of the paper also have a cyclic variation due to the addition of all variable factors.

The effect which these errors have on the performance of the plotter or similar machine consists in what is called the banding effect, which in very short words consists in printing irregularities which adopt the form of bands caused by the fact that the advancement of the paper does not correspond to the intended advance as determined by the advancement of the driving motor.

The aim of the present invention is to provide a method to permit the automatic compensation of said errors, preventing therefore the detrimental banding effects above mentioned.

BRIEF SUMMARY OF THE INVENTION

In order to achieve said objective, the inventor has conceived a method for the automatic compensation of the advancement errors of the paper in plotters and similar machines, which starts from the idea of admitting that each plotter or similar machine will have a different characteristic of the final errors for the advancement of the paper, which depends on the particular components of the machine, admitting that these will have to be manufactured within the closest tolerances which are compatible with the manufacturing means available with the aim of combining a sound execution of the parts and the assembly of the same with costs which are tolerable for the product. Accordingly, the method of this invention provides the calibration of each complete apparatus after its manufacture in order to determine the precise pattern of the variation of the final errors in the advancement of the paper, which usually adopt the form of a cyclic repeatable curve which gives the error for each point of advancement or rotation of the shaft of the platen-roller taken as a reference. After this determination has been made, the data are stored in memory means available to a microprocessing unit which in the current operation of the plotter will be capable to compare the information received from an encoder unit associated to the driving motor of the plotter indicating the precise rotation position of the driving motor, with the stored data of the individual values of the error factor corresponding to each point of rotation of the motor axis being capable of obtaining the corresponding compensation instructions to be transmitted to the driving motor. As it will be easily understood, the number of points to be controlled can be very high taking into account that usually there is a considerable multiplication factor between the driving motor speed and the speed of the platen which, for a given number of positions controlled by the encoder, will mean a much bigger number of points to be controlled on the platen. Thus, if the encoder is considered to control a total of 2.000 points or counts and considering that the number of teeth of the gear may usually be of 50, the corresponding number of points on the platen will amount to 100.000.

A precise method of carrying out the calibration consists in having a printing medium, e.g., a band of paper, fed to the plotter to draw a large number of successive lines each corresponding to equal rotation steps of the platen and, afterwards, to present the printing medium on the platen in a crosswise direction, referring the first line in the succession of lines previously drawn to a zero line of reference on the platen and having afterwards a sensing head movable along a guide parallel to the axis of the platen to detect the precise position of each one of the lines previously drawn, comparing the actual position of each with the corresponding theoretical position referred, for instance, to a corresponding series of marks which have been previously and very precisely made on a reference guide which is parallel to the guide for the sensing device, eventually coinciding with the same. In this way, signals may be sent to the central processing unit of the control means of the plotter corresponding to the precise positioning of each line. The control means will derive and store the errors corresponding to each precise rotation position of the platen, allowing in this way the plotter to introduce the pertinent corrections in the driving of the platen to reduce or to avoid the errors for each position of rotation of the same.

Therefore, the present method will permit the error curves to be easily and accurately drawn upon calibration of each apparatus.

BRIEF DESCRIPTION OF THE DRAWINGS

A typical embodiment of the invention is exemplified in a large format color inkjet printer/plotter as shown in FIGS. 1–2. More specifically, FIG. 1 is a perspective view of an inkjet printer/plotter 210 having a housing 212 mounted on a stand 214. The housing has left and right drive mechanism enclosures 216 and 218. A control panel 220 is mounted on the right enclosure 218. A carriage assembly 300, illustrated in phantom under a cover 222, is adapted for reciprocal motion along a carriage bar 224, also shown in phantom. The position of the carriage assembly 300 in a horizontal or carriage scan axis is determined by a carriage positioning mechanism 310 with respect to an encoder strip 320 (see FIG. 2). A print medium 330 such as paper is positioned along a vertical or media axis by a media axis drive mechanism (not shown). As used herein, the media axis is called the X axis denoted as 201, and the scan axis is called the Y axis denoted as 301.

FIG. 2 is a perspective view of the carriage assembly 300, the carriage positioning mechanism 310 and the encoder strip 320. The carriage positioning mechanism 310 includes a carriage position motor 312 which has a shaft 314 which drives a belt 324 which is secured by idler 326 and which is attached to the carriage 300.

The position of the carriage assembly in the scan axis is determined precisely by the encoder strip 320. The encoder strip 320 is secured by a first stanchion 328 on one end and a second stanchion 329 on the other end. An optical reader (not shown) is disposed on the carriage assembly and provides carriage position signals which are utilized by the invention to achieve optimal image registration in the manner described below.

Figure 1:
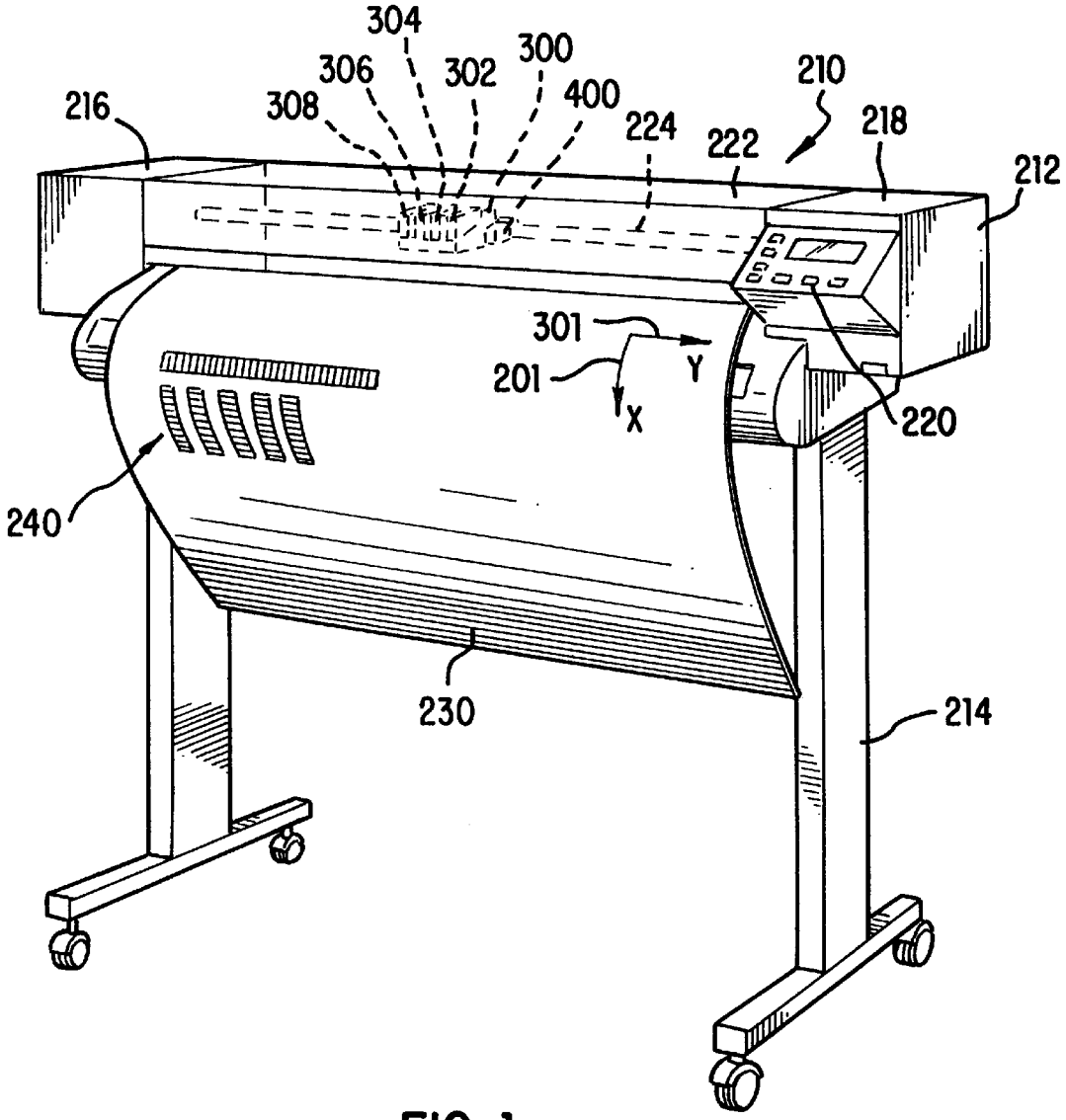
FIG. 1 is a perspective view of a large format inkjet printer/plotter incorporating the present invention.
Figure 2:
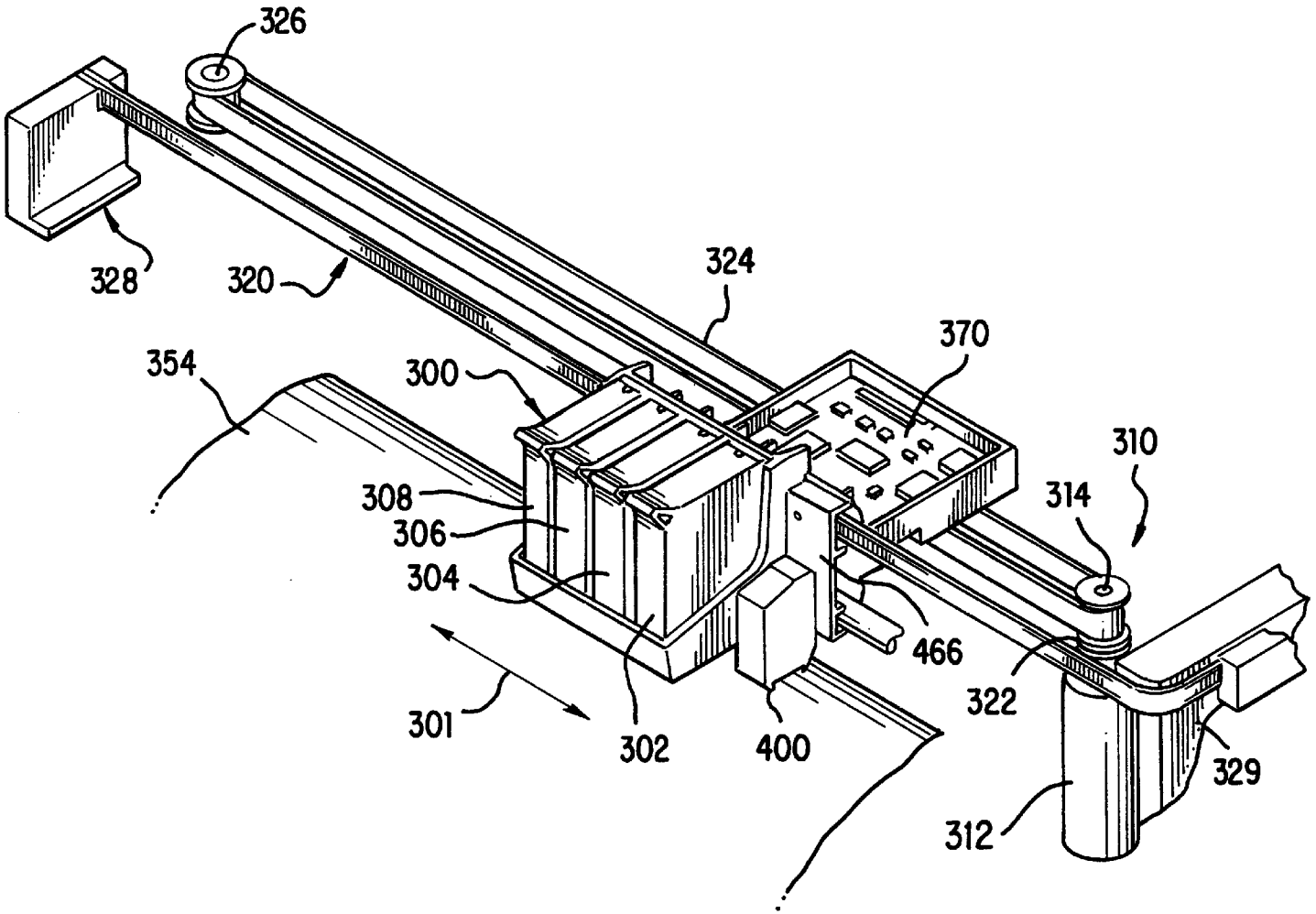
FIG. 2 is a close-up view of the carriage portion of the printer/plotter of FIG. 1 showing a carriage-mounted optical sensor of the present invention.
Figure 3:
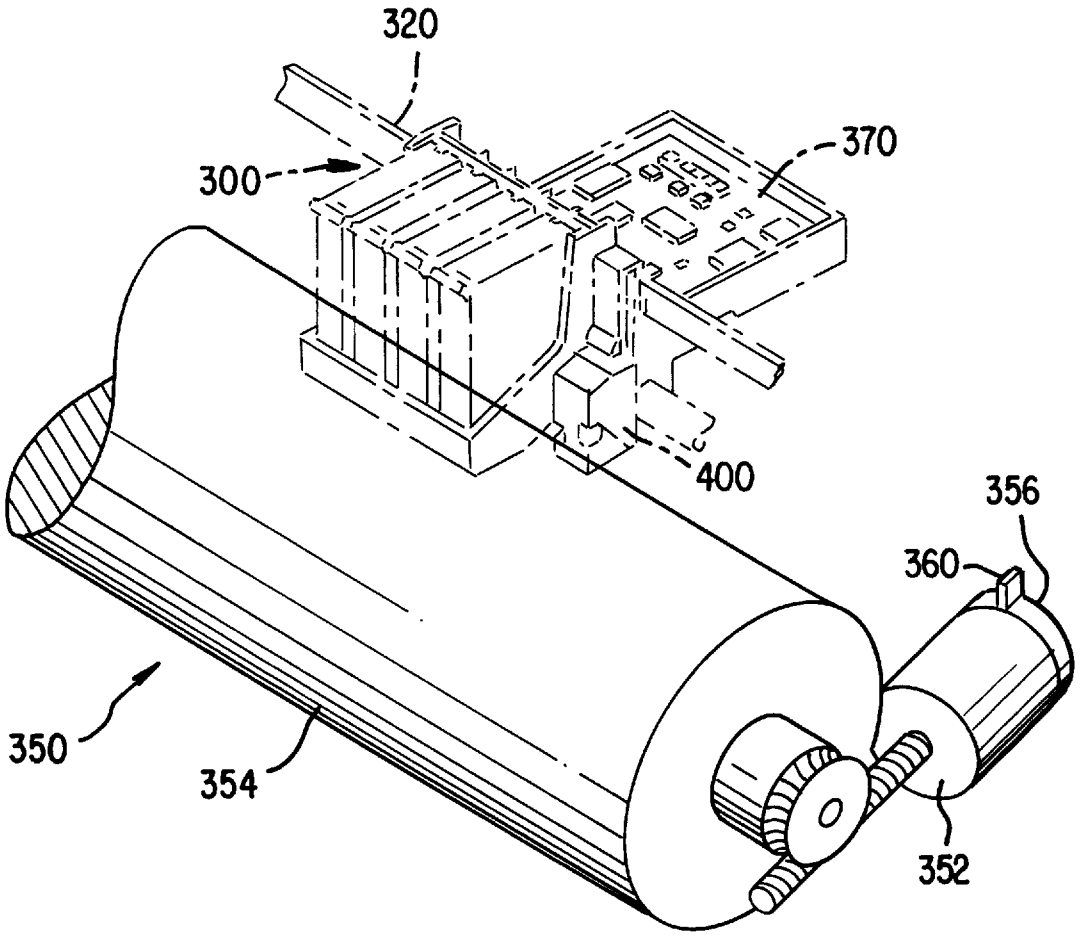
FIG. 3 is a close-up view of the platen portion of the printer/plotter of FIG. 1 showing the carriage in phantom lines.

FIG. 3 is perspective view of a simplified representation of a media positioning system 350 which can be utilized in the inventive printer. The media positioning system 350 includes a motor 352 which is normal to and drives a media roller 354. The position of the media roller 354 is determined by a media position encoder 356 on the motor. An optical reader 360 senses the position of the encoder 356 and provides a plurality of output pulses which indirectly determines the position of the roller 354 and, therefore, the position of the media 230 in the X axis.

The media and carriage position information is provided to a processor on a circuit board 370 disposed on the carriage assembly 100 for use in connection with printhead alignment techniques of the present invention.

The printer 210 has four inkjet print cartridges 302, 304, 306, and 308 that store ink of different colors, e.g., black, magenta, cyan and yellow ink, respectively. As the carriage assembly 300 translates relative to the medium 230 along the X and Y axes, selected nozzles in the inkjet print cartridges 302, 304, 306, and 308 are activated and ink is applies to the medium 230. The colors from the three color cartridges are mixed to obtain any other particular color. Sample lines 240 are typically printed on the media 230 prior to doing an actual printout in order to allow the optical sensor 400 to pass over and scan across the lines as part of the initial calibration.

The carriage assembly 300 positions the inkjet print cartridges and holds the circuitry required for interface to the ink firing circuits in the print cartridges. The carriage assembly 300 includes a carriage 301 adapted for reciprocal motion on front and rear slider rods 303, 305.

As mentioned above, full color printing and plotting requires that the colors from the individual print cartridges precisely applied to the media. Misalignment causes misregistration of the print images/graphics formed by the individual ink drops on the media. This is generally unacceptable as multi-color printing requires image registration accuracy from each of the printheads to within 1/1000 inch (1 mil).

Figure 4:
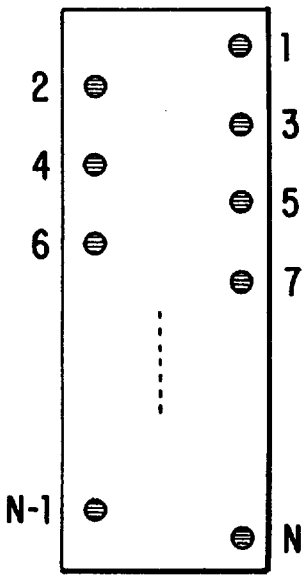
FIG. 4 schematically shows the nozzle plate of a 600 dpi print cartridge having two columns of ink-ejection nozzles.

As shown in FIG. 4, the nozzles in an individual printhead of the presently preferred embodiment are ordered in two columns separated a fixed distance. One column contains the even-numbered nozzles and the other column contains the odd-numbered nozzles. For example, in a black ink 600 dpi printhead, the distance in the media advance direction between nozzle #1 and nozzle #2 is 1/600th inch ("nozzle pitch").

Figure 5:
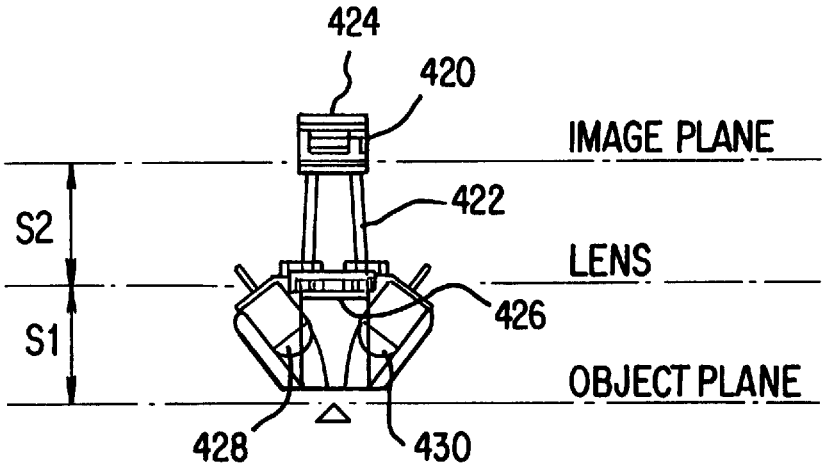
FIG. 5 is a front view of the optical components of the sensor unit of FIG. 2.
Figure 6B:
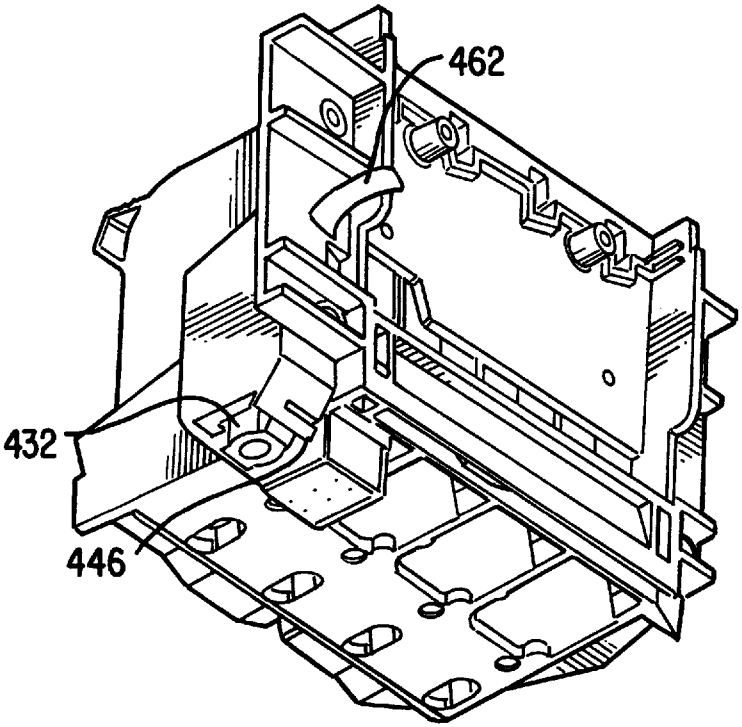
FIGS. 6A and 6B are isometric views respectively looking downwardly and upwardly toward the carriage showing the optical sensor and one print cartridge mounted on the carriage.
Figure 6A:
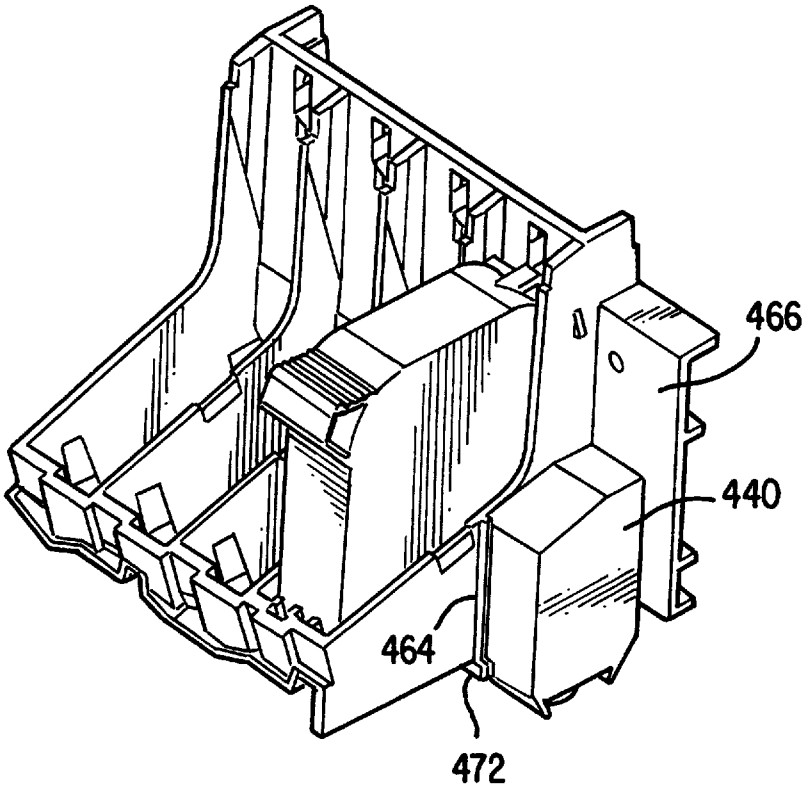

In order to accurately scan across a test pattern line, the optical sensor 400 is designed for precise positioning of all of its optical components. Referring to FIGS. 5, 6A and 6B, the sensor nit includes a photocell 420, holder 422, cover 424, lens 426, and light source such as two LEDs 428, 430.

A protective casing 440 which also acts as an ESD shield for sensor components is provided for attachment to the carriage.

According to the invention, a method is provided for the determination of the error curve which will be stored for its use as a correction pattern for the actual advancement of the motor in order to take into account the individual errors in the advancement of the platen for each point of advancement of the axis of the driving motor.

The method of the present invention provides the previous calibration of each of the complete apparatus to find its particular error curve to be stored for its future use. To carry out said calibration, many different methods could be applied for instance.

Figure 7:
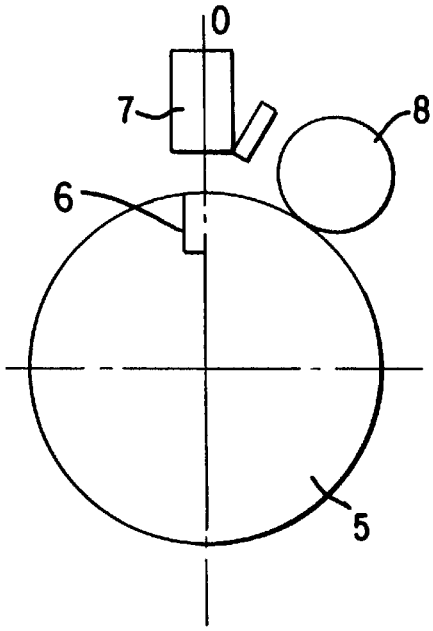
FIGS. 7 and 8 are schematic representations of apparatus for carrying out the calibration techniques of the invention.

A method which has been schematically shown in FIG. 7 in which the platen -5- of the plotter will have a reference mark -6- in order to determine the starting point and the detecting unit -7- will be capable of determining said initial position in order to determine the starting point of the curve. The combination of the platen -5- with a follower disk encoder schematically shown by reference numeral -8- will permit the very precise measurement of the actual advancement of the platen roller. Therefore, the method will permit to determine the error curve for each apparatus to be tested.

Figure 8:
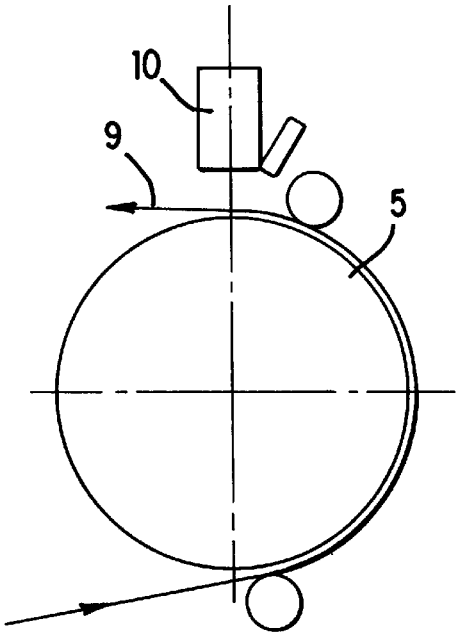

FIG. 8 shows a second method of calibration of the plotter or similar machine taking recourse of a paper -9- having a printed pattern on it with very precisely and evenly spaced straight-markings which will be individually located by the detector -10- which will permit the determination of the position (Px) of the motor for each mark in order to calculate the error for each paper mark.

The error curves will be stored for its subsequent use to compensate the errors for each particular point of rotation of the motor axis.

Figure 9:
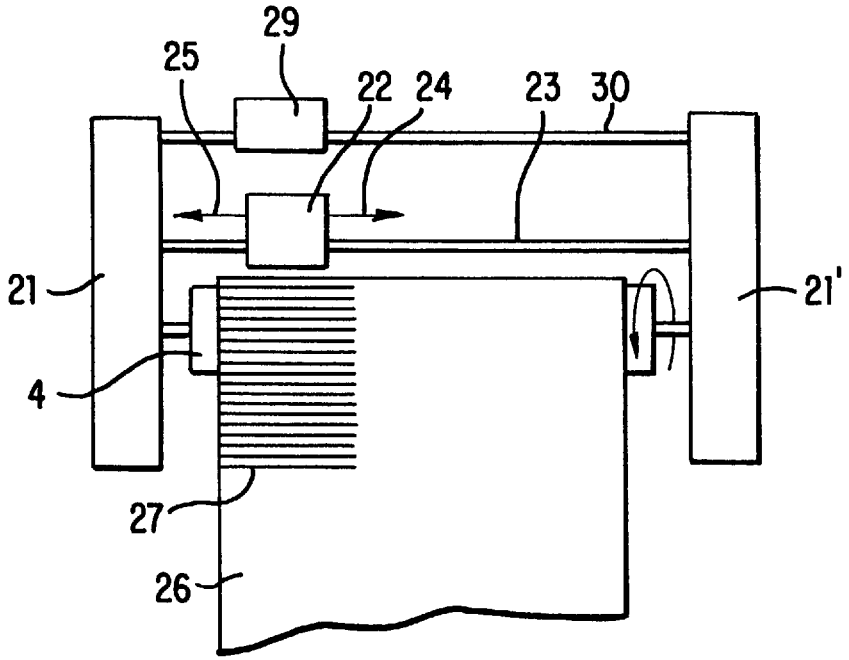
FIGS. 9 and 10 show the test patterns of the present invention being respectively printed and scanned.
Figure 10:
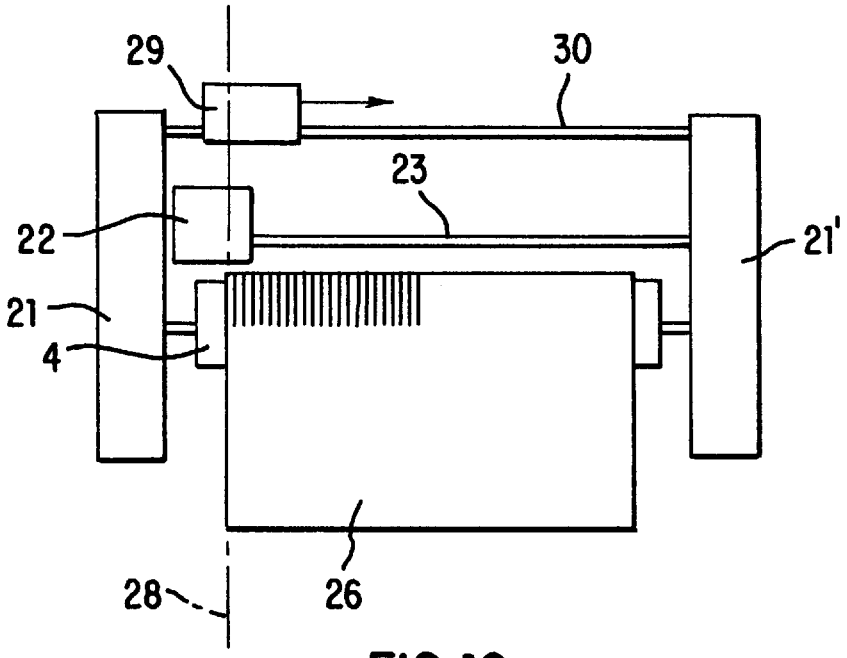

A preferred method according to the present invention is shown in FIGS. 9 and 10. In said figures a plotter has been schematically shown having a rotating platen -4- supported with rotating capability on the frame of the plotter, conceptually shown by supports -21- and -21'-. The printing head -22- of the plotter is capable of movement along the guide -23- advancing as shown by the arrow -24-. After drafting one line, the printing head -22- will return to the initial position as shown by the arrow -25-. A printing medium, e.g. a piece of paper, eventually a segment of a regular band of paper to be used by the plotter, will be fed to the platen -4- to print a high number of successive lines -27- which correspond to predetermined rotating steps of the platen. Afterwards, the same piece of paper -26- will be placed crosswise on the platen -4- and the first of the previously drawn lines -27- will be made to register with a zero line schematically referred to with numeral -28-, which corresponds to the starting position of a sensing unit -29-, which slides along a well calibrated guide -30- which has accurate markings equally spaced and corresponding to the same rotation steps according to which the lines -27- have been previously drawn. The sensing head -29- will move along the guide -30- detecting each of the particular lines -27- and transmitting the corresponding signals to the control means of the plotter to determine and store the individual errors corresponding to each rotation step of the platen, for its subsequent use to compensate said errors for each particular point of rotation of the motor axis, compensating in this way the added errors which result in the banding effect.

Figure 11:
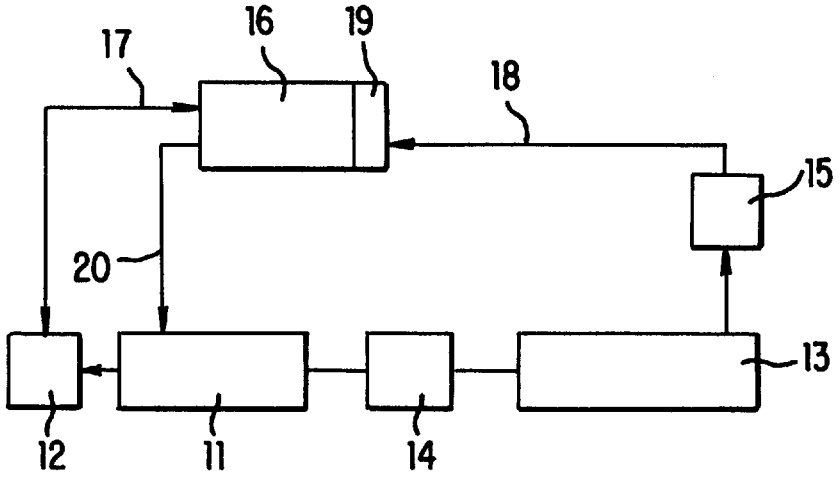
FIG. 11 is a block diagram of the invention.

FIG. 11 shows a conceptual arrangement of elements to carry out the correction showing a driving motor -11- which has associated an encoder -12- and which drives the platen roller -13- intermediate a transmission unit -14- for example of the worm gear type. In the figure, a second encoder -15- has been shown corresponding to the calibrating version explained previously. A central processing unit (CPU) -16- will receive the precise readings from encoder -12- which has been shown by the arrow -17- to indicate the precise position of the axis of motor -11-, said CPU -16- will have the capacity to receive as well the precise readings from the encoder -15-, as shown by the arrow -18- which will have permitted the previous determination of the error curve which will be stored in a memory area -19-. Accordingly, in the usual operation of the apparatus when the central processing unit -16- receives the actual readings -17- from the encoder -12-, it will be capable to find the individual correction passing the necessary indications as shown by the arrow 20 to the driving motor 11 in order to compensate for the final driving errors that would otherwise be transmitted to the printing medium.

Figure 12:
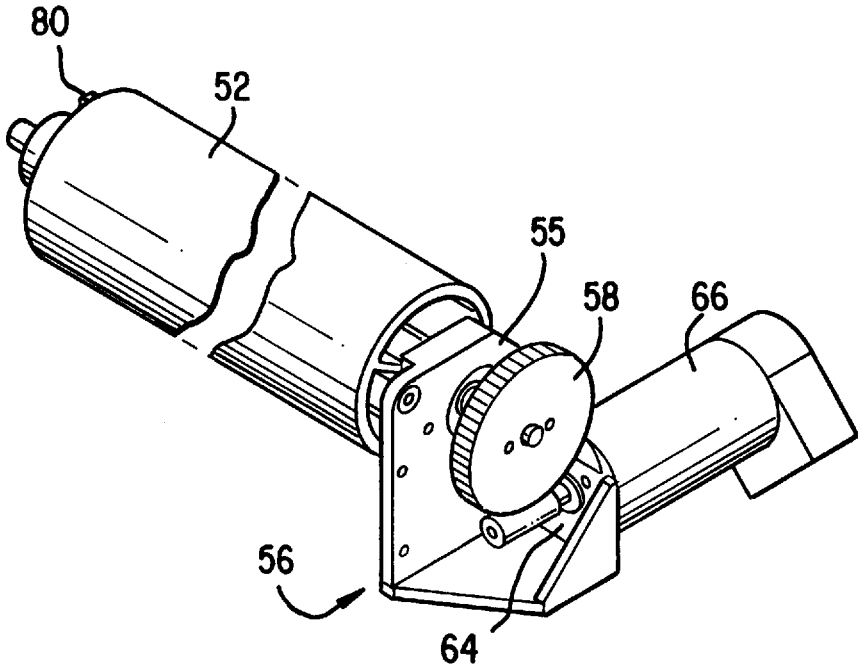
FIGS. 12 and 13 show isometric views of the drive mechanism for advancing the media.
Figure 14:
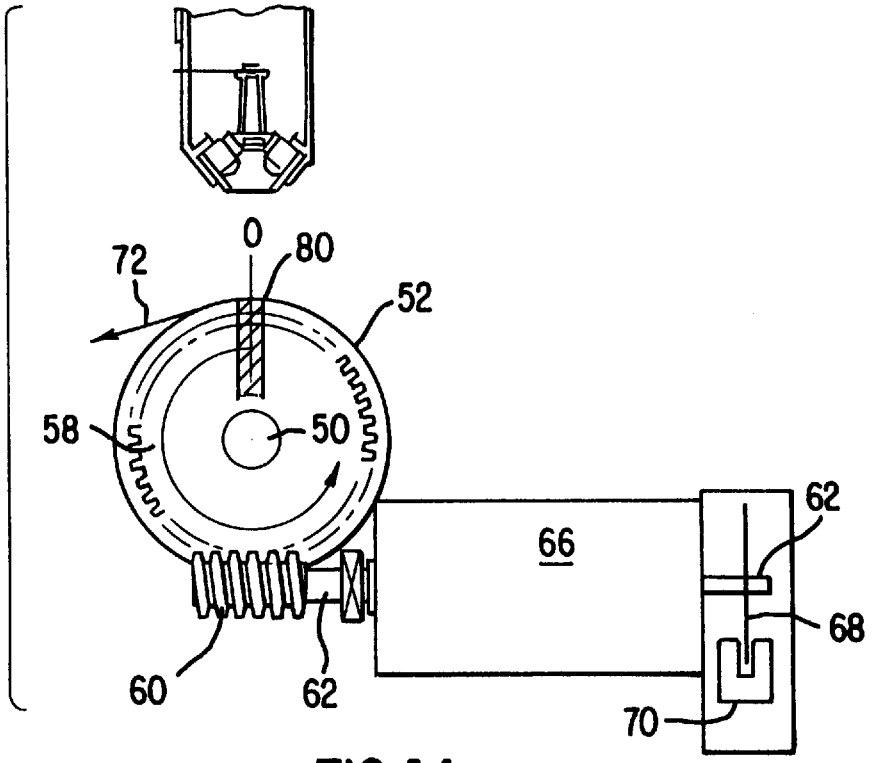
FIG. 14 is a partial section view from the drive end of the media platen.
Figure 13:
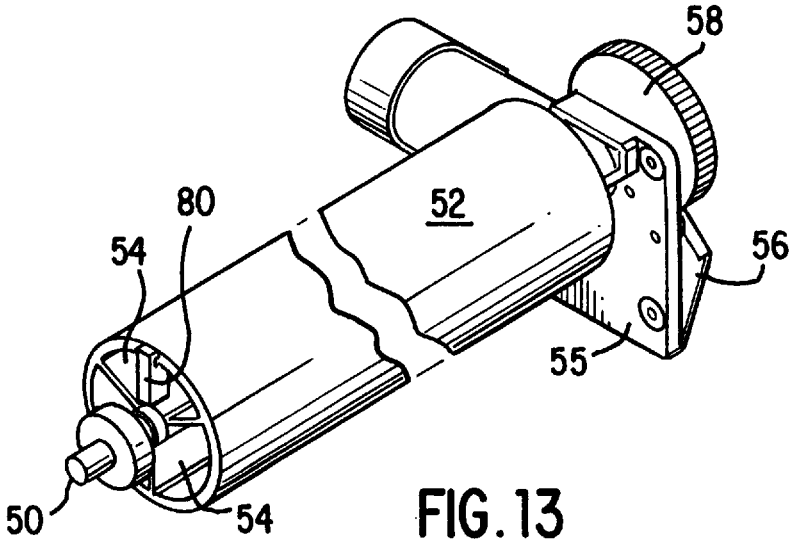

As shown in FIGS. 12–14, there is a high precision drive train for transferring movement to the media as it is advanced after a printing swath has been completed by the carriage. In that regard, a central shaft 50 transfers rotational motion to a platen roller 52 through radial ribs 54. At one end the central shaft is journaled in one leg 55 of a support bracket 56 and carries a helical gear 58 on its outer end which engages a worm gear 60 which is fixedly mounted on a forward end of a motor shaft 62. The motor shaft is normal to the central shaft 50, is journaled in another leg 64 of the support bracket 56, and is driven by motor 66. A rearward end of the motor shaft 62 carries an encoder disc 68 having a 2000 count perimeter which passes through a zipper-encoder 70 for measuring incremental movements of the motor shaft and therefore measures incremental movement of the platen roller as it pulls a sheet of media 72 past a print zone.

A radially mounted white reference marker 80 is carried on the platen roller at an end opposite from the motor drive mechanism, and at the beginning of a plot the platen is always rotated so that the optical sensor can sense the position of the reference marker. Thus, it will be appreciated that each calibration procedure will begin with the platen at the same starting position.

In accordance with the calibration procedure, the formula for achieving accurate media advance is as follows:

$$\Theta = X - P$$

where:

$\Theta$=position error

P=actual paper position

X=paper position calculated from knowing the motor position (and gear train multiplier.

In the print calibration plot, the lines are a representation of the motor position (X's), and therefore by scanning the lines of the print calibration plot with the carriage-mounted optical sensor, it is possible to generate the actual position vectors (P's).

The invention therefore provides a close-loop calibration technique so that during the life of a printer as additional errors may arise which create errors in the rotational motion of the motor mechanism/roller platen, an error correction can be made in order to assure precise predictable advance of the media and thereby avoid the problems of banding which often occurred in prior art swath printers/plotter.

While an exemplary embodiment of the invention has been shown and described, it will be appreciated that additional changes, improvements and modifications can be made without departing from the spirit and scope of the invention as set forth in the following claims.

I claim:

1. Method for the compensation of errors in the advancement of the printing medium in a plotter machine or similar having a platen and a driving stepping motor, characterized by the following successive operational stages:

a) proceeding with the calibration of each individual plotter machine by determining an error curve correlating the actual positions of advancement of the axis of the driving stepping motor of the platen for the printing medium with the positions which correspond to the actual advancement of the printing medium driven by the platen roller;

b) determining the error curve for each reference point of rotation of the axis of the stepping driving motor, the error curve being the actual difference as compared to the actual advancement of the band of paper corresponding to said point;

c) storing the data corresponding to the error curve as individual error for each reference point of rotation of the axis of the stepping driving motor in memory means available to a central processing unit to control said driving motor;

d) determining and generating by means of an encoder associated to the driving motor the actual successive reference positions of said driving motor and feeding this information to the central processing unit;

e) sending the pulses to the driving motor to determine the individual rotation of the same for each reference point of said driving motor, taking into account the particular error in the advancement of the printing medium for each of said reference points to compensate for the error.

2. Method, according to claim 1, characterized by the association of a follower disk encoder with the platen roller for the printing medium to precisely determine the actual advancement positions of the platen, corresponding to each reference point of advancement of the axis of the driving motor.

3. Method, according to claim 1, characterized by the arrangement of a paper band with marks precisely and evenly spaced, to be driven by the roller platen, locating a zero mark on the platen by means of a sensor to detect the marks on the paper, moving the marks under the sensor and gathering the motor position for each mark in order to calculate the error for each paper mark, between the actual rotation position of the motor axis and the actual positioning of the marks in the paper band after its corresponding advancement.

4. Method according to claim 1, characterized in that it comprises:

a) drawing a series of multiple successive lines on a laminar printing medium, each corresponding to a predetermined angle of rotation of the axis of the platen;

b) feeding crosswise the laminar printing medium having the previously drawn lines to the platen of the same plotter;

c) sensing the actual position of each of the previously drawn lines referring the same to the theoretical position corresponding to the precise position of rotation of the platen;

d) transmitting the errors to the central processing unit of the control means of the plotter to proceed according to point e) of claim 1.

5. Apparatus to carry out media advance calibration, which has a platen for supporting a printing medium and means to rotate the platen about an axis comprising a motor and gear transmission means, a printing head displaceable along guiding means parallel to the axis of the platen, characterized for having a calibrated straight guide parallel to the axis of the platen and sensor means displaceable along said calibrated guide, said sensor reading the actual location of each of multiple straight lines previously drawn on a printing medium supported on the platen in crosswise direction with respect to the direction of drafting of the same by the plotter, and said sensor registering a zero position coinciding with the first one of the multiple straight lines drawn on the printing medium, and means to send compensating signals corresponding to the detected positions of the successive lines on the printing medium to a processing central unit.

6. Apparatus according to claim 5, characterized in that the calibrated guide has multiple successive markings equally and accurately spaced to each other in positions which correspond to the same theoretical incremental angles of rotation of the platen than those which have determined the drafting of the actual successive lines on the printing medium.

* * * * *